United States Patent [19]

Kinley

[11] Patent Number: 4,624,307

[45] Date of Patent: Nov. 25, 1986

[54] EXPLOSIVE PERFORATING TOOL

[75] Inventor: Karl S. Kinley, Houston, Tex.

[73] Assignee: J. C. Kinley Company, Houston, Tex.

[21] Appl. No.: 780,621

[22] Filed: Sep. 26, 1985

[51] Int. Cl.[4] ..... E21B 43/112

[52] U.S. Cl. ..... 166/55.3; 89/1.15; 102/531; 166/63

[58] Field of Search ..... 166/55.2, 55.3, 63; 89/1.15; 102/531

[56] References Cited

U.S. PATENT DOCUMENTS

| | | | |
|---|---|---|---|
| 2,185,303 | 1/1940 | Kinley | 166/63 |
| 2,336,812 | 12/1943 | Spencer | 175/4.56 |
| 2,381,081 | 8/1945 | Schlumberger | 175/4.55 |
| 2,426,106 | 8/1947 | Kinley | 166/55.3 |
| 3,176,770 | 4/1965 | Ehlert | 166/55.3 |
| 3,199,287 | 8/1965 | Kinley | 166/63 |
| 3,199,593 | 8/1965 | Kinley | 166/63 |
| 3,366,179 | 1/1968 | Kinley et al. | 166/63 |
| 3,411,597 | 11/1968 | Kinley et al. | 166/63 |
| 3,447,604 | 6/1969 | Kinley et al. | 166/63 |

*Primary Examiner*—Stephen J. Novosad
*Assistant Examiner*—William P. Neuder
*Attorney, Agent, or Firm*—Pravel, Gambrell, Hewitt & Kimball

[57] ABSTRACT

An explosive perforating tool has an elongated barrel having a piston disposed substantially within. A radial passage extends from the outer surface of the barrel into the longitudinal cavity, thereby allowing the piston to be explosively driven from the tool through the radial passage. The piston has a longitudinal opening therethrough. When an explosive charge is set off increasing the pressure of a lubricating fluid within the longitudinal cavity, pressure is uniformly built up all around the piston and is the primary mode of force propelling the piston against the tubing. Vent openings are provided in the elongated chamber to allow the lubricating fluid to escape, thereby regulating the rate of pressure dissipation within the cavity to control the force with which the piston is propelled against the tubing. Spacers of varying size can be attached to the barrel to allow the tool to be used in different sizes of tubing.

27 Claims, 6 Drawing Figures

EXPLOSIVE PERFORATING TOOL

FIELD OF THE INVENTION

This invention relates to downhole tools used for perforating tubing using an explosive charge.

BACKGROUND OF THE INVENTION

Frequently in drilling operations it is desirable to perforate the tubing string within the well casing to allow well fluids to flow into the tubing string. In some instances it is desirable to penetrate the tubing string with an insert having a known internal bore so that precise calculation of well flow rates can be made.

In order to penetrate the tubing string and embed an insert therein, explosive perforating guns such as that disclosed in U.S. Pat. No. 3,199,287 have been used. U.S. Pat. No. 3,199,287 disclosed a drive wedge 40 actuated by an explosive charge. The drive wedge mechanically contacted the piston and propelled the piston through an opening in the tool and against the tubing to be perforated. The explosive gases then continued to propel the drive wedge until it came in contact with a stop wedge 60 whereupon the explosive gases slowly vented through various unsealed passages within the tool. Due to the sliding and highly loaded contact between the drive wedge and the piston, the drive wedge had to be stopped by a stop wedge before the explosive gases could reach the piston bore. If the drive wedge had not been stopped by the stop wedge while the drive wedge was still at the position shown in FIG. 1 of the patent, the drive wedge could have become jammed in the barrel when the cylindrical portion of the drive wedge encountered the piston. Thus, metal deformation would occur on the drive wedge and cause the wedge to jam itself in the bore on the far side of the piston bore.

In order to prevent that phenomenon, a flat was provided on the side of the wedge near its upper end. Such flat assured that the surface contact between the piston and the drive wedge always remained in a line contact, rather than a point contact which would have resulted if an arcuate surface on the wedge contacted a beveled flat surface on the piston. Because the drive wedge required the use of such flat, an effective seal was maintained between the drive wedge and the barrel by providing the upper section of the drive wedge with a full radius. Since the part of the drive wedge that had the full radius could not be allowed to cross the piston's bore because of the potential jamming problems, the drive wedge was required to be stopped by the stop wedge so that the recess between the flat and the full radius of the drive wedge would be positioned at the piston bore. This intermediate section, having a reduced diameter, was positioned opposite the piston bore and allowed the piston to come back into the tool after it rebounded from the tubing wall. That construction had a disadvantage in that the drive wedge was extremely costly to fabricate and piston retraction was limited by the thickness of the drive wedge at such intermediate section. Finally, stopping the drive wedge with the intermediate section aligned with the piston bore was critical, if the piston was to be allowed to retract into the tool. If a misalignment occurred, the piston could not retract into tool, and significant damage might result to the tool in attempting to extricate it from the tubing.

Also, since the drive wedge was explosively driven into the stop wedge, on occasions, it became difficult to pry apart the drive wedge from the stop wedge so that that tool could be reloaded.

In many applications, it is desirable to aim the perforating tool so that the perforation occurs and the insert is embedded in the tubing wall adjacent the location having the maximum annular cross-sectional area between the tubing string and the casing. In a deviated well, the most likely position for the maximum annular space is likely to be on top of the tubing. In order to insure that the insert is placed in this particular location, the piston bore must be positioned in the pipe so that it always faces upwardly in a deviated hole. Prior designs had runners welded to thin sections of tubing that slid over the barrel of the perforator. These two runners acting as spacers to allow the tool to be used in different sizes of tubing, would not let the tool roll within the tubing.

The perforating tool of the present invention incorporates features for overcoming some of the limitations of prior tools. In the perforating tool of the present invention, hydraulic forces built up due to the setting off of the explosive charge propel the piston from the barrel. It is only if additional force is needed to perforate the tubing that the drive wedge makes a mechanical contact with the piston. The drive wedge is driven completely past the piston bore so that after firing, the piston may fall all of the way back into the barrel. The piston has a longitudinal opening therethrough so that hydraulic pressure is equalized to either side of the piston within the barrel. Vent openings are selectively placed to allow the lubricating fluid to escape as well as to allow the explosive gases to escape, thereby avoiding the necessity of having to use the pressure of the explosive gases to drive the drive wedge into contact with the stop wedge. A piston adapter segment is connected to the top side of the piston so that if for some reason the piston does not fully retract into the barrel, the adapter segment can be sheared off and the tool removed from the tubing. An adapter segment is further designed to accommodate various sized inserts, thereby eliminating the need to have individual piston designs for each insert. The perforating tool of the present invention by using rounded counterweights and spacers having a flat surface machined thereon in combination with a belly spring, allows the tool to roll within the tubing until the desired depth is reached. The belly spring forces the flat portions of the spacers against the tubing surface to stabilize the tool before it is fired. These and other improvements can be appreciated from a further review of the specification and the drawings.

SUMMARY OF THE INVENTION

An explosive perforating tool has an elongated barrel having a piston disposed substantially within. A radial passage extends from the outer surface of the barrel into the longtiudinal cavity, thereby allowing the piston to be explosively driven from the tool through the radial passage. The piston has a longitudinal opening therethrough. When an explosive charge is set off increasing the pressure of a lubricating fluid within the longitudinal cavity, pressure is uniformly built up all around the piston and is the primary mode of force propelling the piston against the tubing. Vent openings are provided in the elongated chamber to allow the lubricating fluid to escape, thereby regulating the rate of pressure dissipation within the cavity to control the force with which the piston is propelled against the tubing. Spacers of varying size can be attached to the barrel to allow the tool to be used in different sizes of tubing.

DETAILED DESCRIPTION OF THE PREFERRED EMBODIMENT

Figure 1A:
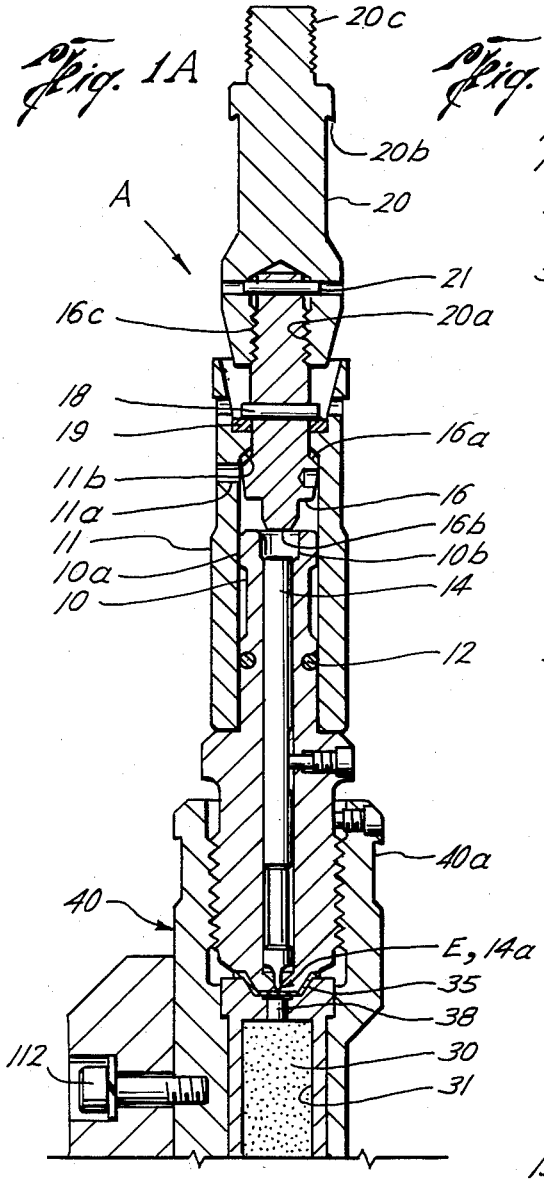
FIG. 1A is a cross-sectional elevational view of the upper portion of the tool illustrating the placement of the explosive charge and means for setting it off.

The perforating tool A of the present invention includes explosive means E (FIG. 1A), pressure dissipation means D (FIGS. 1B and 2) and a piston P. Explosive means E is connected to the upper end 40*a* of barrel 40. The perforating tool A includes a firing pin body 10 which is positioned within a sleeve 11 by means of suitable shear pins 12, or other suitable connecting means. With the use of shear pins 12, the sleeve 11 may be separated from the firing pin body 10 by manipulation of the wireline supporting the tool A if such becomes desirable or necessary, so that the fishing neck 10*a* at the upper end of the body 10 is exposed for a fishing operation as will be well understood by those skilled in the art.

Firing pin rod 14 is adapted to move downwardly and impart a movement to disc 35 which in turn sets off detonator 38 igniting explosive charge 30 which is located within chamber body 31.

The sleeve 11 has one or more openings 11*a* to prevent a fluid lock within housing or sleeve 11 as punch 16 moves with respect to sleeve 11. The punch 16 is provided with an upper included annular shoulder 16*a* which engages a corresponding internal shoulder 11*b* in the sleeve 11 so that when the punch 16 is in the raised position, FIG. 1A, the entire tool A is supported from the wireline or other means extending to the surface of the well (not shown). The punch 16 is suspended in an upper position by means of a shear pin 18 which is located above a shear ring 19 and is adapted to be sheared upon a downward movement of the punch 16. Pin 18 is sheared by downward impact for engagement with the shear ring 19 so as to permit a movement of punch 16 downwardly to cause the lower end 16*b* of the punch to enter bore 10*b* of the firing body 10 and to strike the upper end of the firing pin rod 14 to cause it to move downwardly. The upper end of the punch 16 may be connected to the wireline (not shown) in any suitable manner, or by using an adapter 20. Adapter 20 is threaded by the engagement of threads 16*c* and 20*a* and by the locking of the pin 21 which extends from the pin 16 into adapter 20 to prevent rotation thereof. The adapter 20 preferably has a fishing neck 20*b* at its upper end which may be used for a fishing operation in some instances. A rope socket (not shown) can be connected to threads 20*c* as one method of connecting a suitable wireline or casing to the upper end of tool A. Wireline operated jars are usually connected above the adapter 20.

The firing pin rod 14 has a projection 14*a* which is adapted to puncture the sealing disc 35 and strike the detonator 38 for the detonation of the detonator 38 and the subsequent explosion of the explosive powder or charge 30.

Cartridge 31 has an end cap 36 which is severed from cartridge 31 when the charge 30 is exploded. A series of resilient seals 37 are position below the plug 36 to seal against the bore 40*b* to prevent any substantial loss of explosive pressure when the explosive charge 30 is fired.

It is understood that when the charge 30 is detonated mechanically as illustrated in FIG. 1A, that the lower end of the tool must be supported on a conventional collar or tubing stop so that the downward jarring action necessary to drive pin 14 against seal 35 and set off detonator 38 does not physically jar the tool A and affect the aiming of piston P. It is also understood by those skilled in the art that through the use of a conductive wireline, the charge 30 can be set off electrically, thereby obviating the need for support of tool A. The remaining details of the mechanical method of detonation as shown in FIG. 1A are more fully discussed in U.S. Pat. No. 3,199,287.

Barrel 40 has an internal longitudinal cavity 40*c* which is subdivided into a drive zone 40*d* and a stop zone 40*e* by piston P. A radial passage 40*f* is disposed transversely to the longtudinal axis of cavity 40*c* and is preferably circular in shape.

Before actuation, longitudinal cavity 40*c* is filled with a lubricating fluid (not shown) such as a light weight grease. The lubricating fluid may be pumped into longitudinal cavity 40*c* through openings 40*g*, 40*h* or 40*i* (see FIGS. 1B and 2). Barrel 40 further includes explosive gas vents 40*j* and 40*k* (FIG. 2) as will be discussed in more detail below.

Figure 1B:
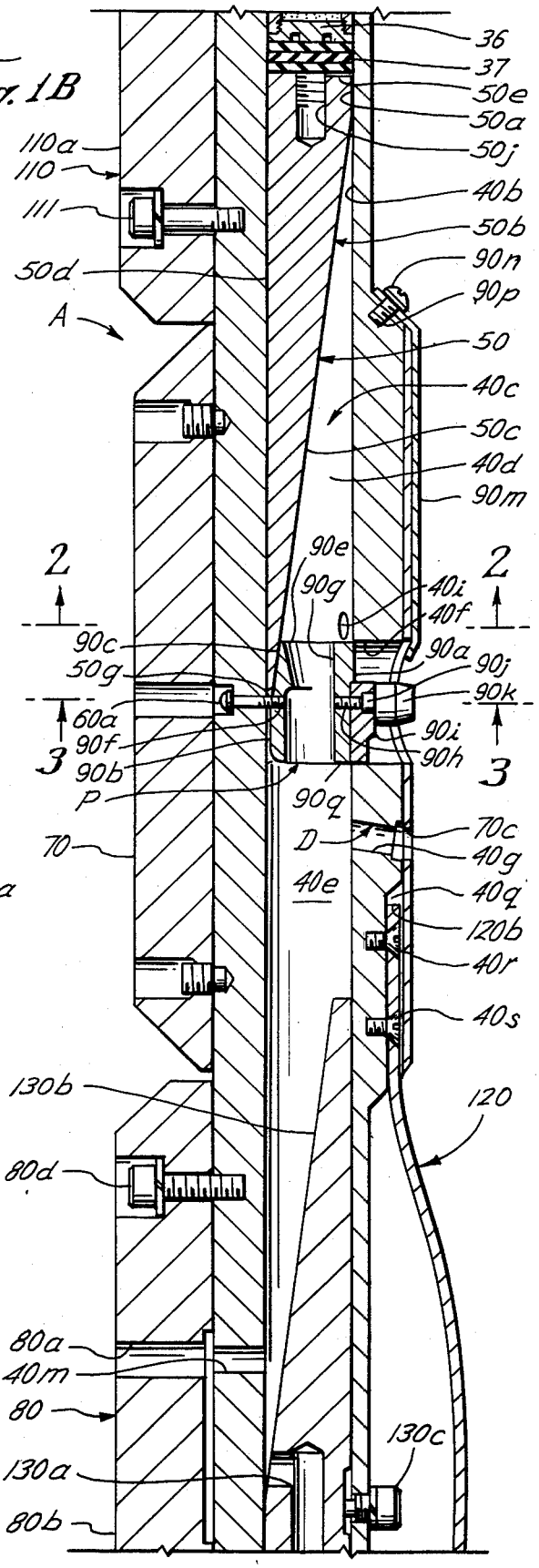
FIG. 1B is a continuation of the view shown in FIG. 1A illustrating the longitudinal cavity within the barrel which houses the piston.

Explosive means E further includes a drive wedge 50 disposed within longitudinal cavity 40*c* for movement between an initial position as shown in FIG. 1B and a fired position wherein wedge 50 is disposed within stop zone 40*e*.

Wedge 50 has a cylindrical upper end 50*a* which conforms to the shape of bore 40*b*. The lower end 50*b* has a flat tapered surface 50*c* which is adjoined on both sides by cylindrical surface 50*d*. Top surface 50*e* has a threaded opening 50*f* therethrough to assist in removing the drive wedge 50 after it has been fired into stop zone 40*e*. In the initial position of drive wedge 50, its lowermost point 50*g* is disposed against piston retaining pin 60*a*. Pin 60*a* is designed to be sheared by movement of drive wedge 50 and can be constructed from a suitable resilient material having sufficient strength to support pistion 50 in its initial position as shown in FIG. 1B.

Figure 2:
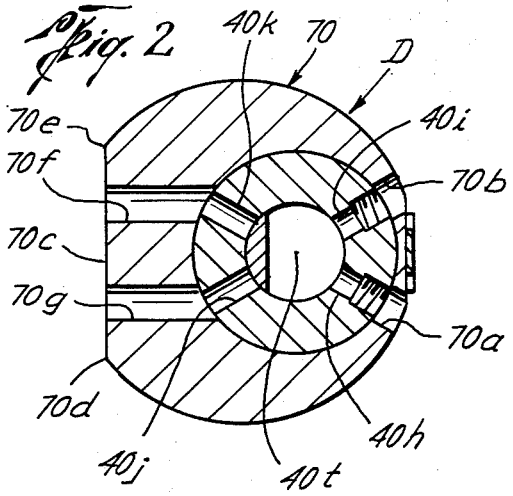
FIG. 2 is a sectional view taken along lines 2—2 of FIG. 1B.

When drive wedge 50 is in the initial position, explosive gas vent bores 40*j* and 40*k* are covered by cylindrical surface 50*d*. Upper vent bores 40*i* and 40*h* are disposed radially opposite explosive gas vent bores 40*j* and 40*k* and provide flow communication between drive zone 40*d* through barrel 40. As seen FIG. 2, upper vent bores 40*h* and 40*i* are aligned with bores 70*a* and 70*b*, respectively, of sleeve 70, thereby allowing the lubricating fluid to escape through longitudinal cavity 40*c* and into the surrounding well fluids within the tubing (not shown). Barrel 40 further contains lower vent bore 40*m* as well as opening 40*g*. These lower vent bores 40*g* and 40*m* provide fluid communication from stop zone 40*e* through barrel 40 and into the surrounding well fluids within the tubing when drive wedge 50 is propelled from its initial position to fired position. As seen in FIGS. 1B and 2, opening 40*g* is in alignment with 70*c* to permit the lubricating fluid to flow from stop zone 40*e* into the surrounding well bore within the tubing (not shown). Similarly, opening 40*m* is in alignment with opening 80*a* of counterweight 80. The combined action of upper vent bores 40*h* and 40*i* with lower vent bores 40*g* and 40*m* as well as passage 130*a* and explosive gas vent bores 40*j* and 40*k* regulates the force with which the piston P is propelled against the tubing by regulating the rate of pressure build up and dissipation within longitudinal cavity 40*c* as the drive wedge 50 is propelled from its initial to its fired position.

Figure 3:
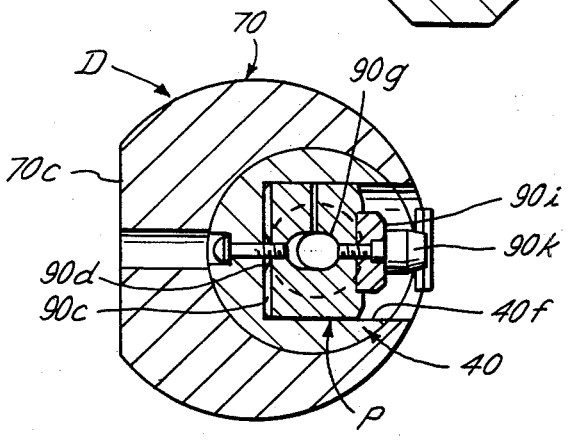
FIG. 3 is a sectional view taken along lines 3—3 of FIG. 1B.

As shown in FIG. 1B and 3, piston P has an outer surface 90*a* and an inner surface 90*b*. Inner surface 90*b* includes taper 90*c* at its upper portion. As seen in FIG. 3, the tapered surface 90*c* has an arcuate depressed surface 90*d* which extends from the upper end 90*e* of piston P, which is adjacent drive zone 40*b*, up to bore 90*f*. Bore 90*f* is threaded and of a diameter to accept threaded pin 60*a* for retaining piston P in its initial running-in position within bore 40*b*. Piston P further includes a longitudinal bore 90*g* which allows fluid communication through piston P from drive zone 40*b* to stop zone 40*e* as piston P is propelled from its initial to its fired position.

Surface 90*a* further includes a suitable number of openings 90*h* to faciltate the attachment of adapter segment 90*i* with threaded fasteners 90*j*. Adapter segment 90*i* is capable of temporarily holding an insert 90*k* via brazing or a weak weld designed to yield on impact of the insert 90*k* with the tubing wall. When piston P is propelled from its initial to its fired position, insert 90*k* penetrates the tubing (not shown) and remains embedded through the tubing after the tool A is removed from the well, as will be well understood. As insert 90*k* pierces and becomes embedded within the tubing, piston spring 90*m* is contacted by surface 90*a* of piston P to urge piston P including adapter segment 90*i* back into the tool A through radial passage 40*f* so that the tool A may be retrieved from the tubing. Spring 90*m* is attached to barrel 40 by means of fastener 90*n* which is inserted through piston spring 90*m* and into threaded opening 90*p*.

Adapter segment 90*i* is large enough to accept inserts 90*k* of various sizes depending upon the need in a particular application. Furthermore, should piston spring 90*m* be unable to bias piston P back into radial passage 90*f*, leaving adapter segment 90*i* protruding from barrel 40, the tool A can be retrieved without doing serious damage to the piston P by exerting an upward force on tool A thereby shearing fasteners 90*j* and the allowing the tool to be retrieved from the well.

Figure 1C:
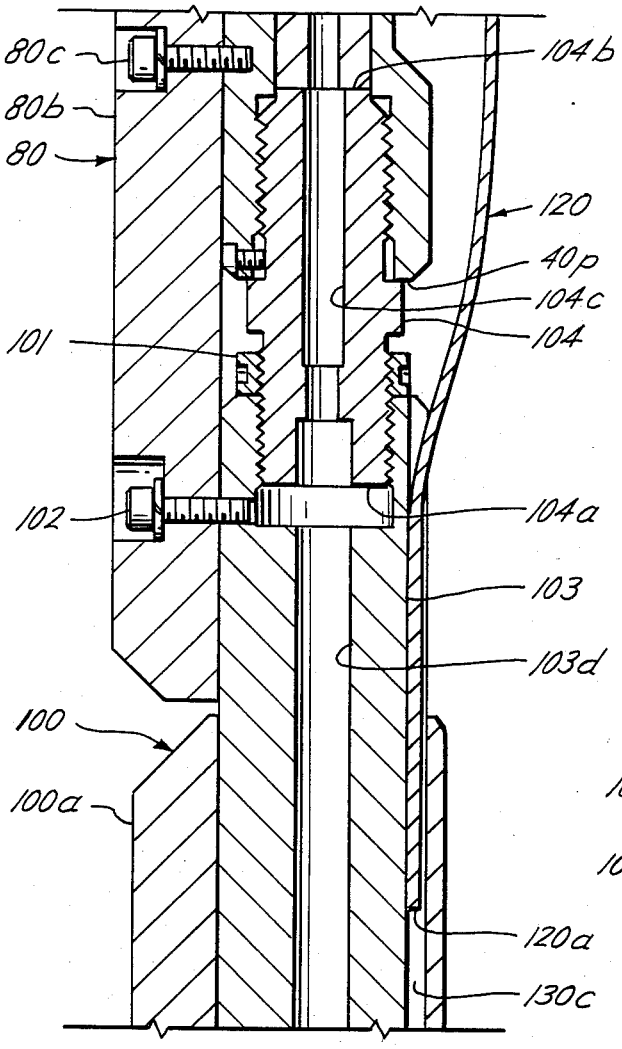
FIG. 1C is a continuation of the view illustrated in FIG. 1B showing barrel extensions and counterweights applied thereto.
Figure 1D:
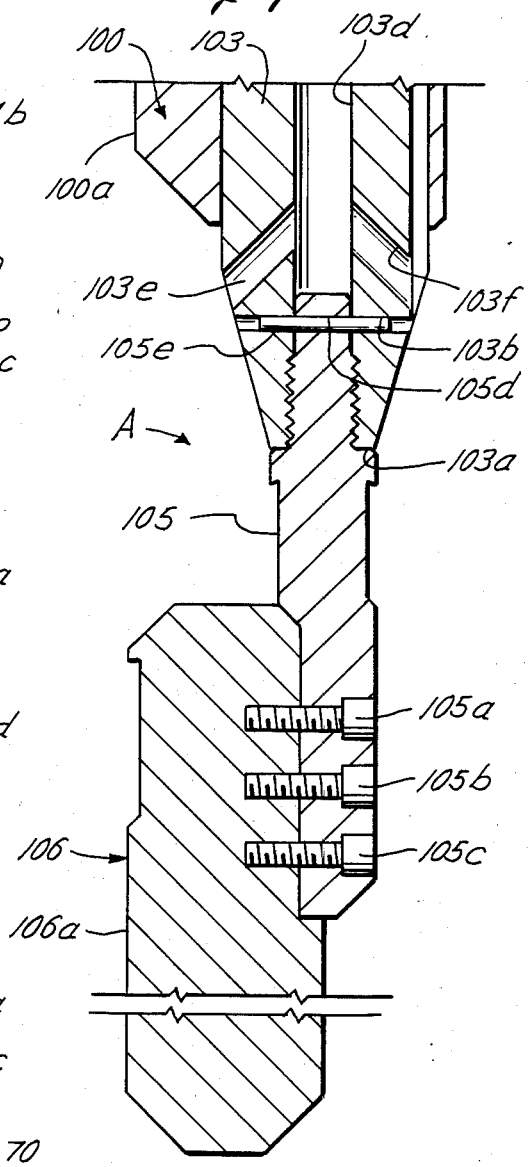
FIG. 1D is a continuation of the view illustrated in FIG. 1C shown in the application of additional counterweights.

On occasions where the tool A is to be used in a deviated well, it is necessary to properly aim the tool A before it may be fired. The reason is that in such applications it is desirable to place the insert 90*k* in the tubing wall adjacent the maximum available space between the tubing string and casing string. Since the most likely position for the widest annular space is on the uppermost side of the tubing at any particular location, the tubing having settled to the bottom of the casing due to the deviation in the well, it is desirable to imbed insert 90*k* in the top of the tubing. Accordingly, it is important to orient radial passage 40*f* so that it faces upwardly towards the top of the tubing to accomplish this purpose. Once the tool A is placed in position within the deviated tubing, it is advantageous to stabilize the tool before it is fired to avoid making an oblong hole in the tubing with the insert. An oblong hole will quickly result in leakage at the periphery of the insert 90*k* after it is embedded in the tubing which could result in the ultimate dislodging of the insert 90*k*. Additionally, it is desirable to use the same tool A in several different tubing internal diameters. To accomplish this, spacers 70 and 100 (FIGS. 1B and 1C) are demountably affixed to barrel 40 and extension tube 103, respectively. Spacer 70 has a flat surface 70*c* and spacer 100 has a flat surface 100*a* which is aligned in the same plane as flat surface 70*c*. Alignment between flat surfaces 100*a* and 70*c* is insured by use of lock ring 101 (FIG. 1C) and alignment pin 102. Spacer 100 is mounted to extension tube 103. Extension 103 is connected to adapter 104 which is in turn secured to the lower end 40*p* of barrel 40. Counterweight 80 has a rounded outer surface 80*b* and is fastened to barrel 40 via fasteners 80*c* and 80*d*. As seen in FIG. 1C, counterweight 80 overhangs the lower end 40*p* of barrel 40. Alignment pin 102 serves to connect counterweight 80 to extension tube 103, thereby insuring the alignment of flat surface 100*a* with flat surface 70*c*.

An additional counterweight 110 is secured to barrel 40 via fasteners 111 and 112.

The lower end 103*a* of extension tube 103 is adapted to connect extension 105 to which an additional counterweight 106 can be attached. Extension 105 is connected to counterweight 106 via fasteners 105*a*, 105*b* and 105*c*. To insure the proper orientation for counterweight 106, extension 105 has an alignment bore 105*d* which can be aligned with bore 103*b* of extension 103.

As seen in FIG. 1C, an annular space 103*c* is provided between spacer 100 and extension 103. A belly spring 120 has a lower end 120*a* which extends into annular space 103*c* for support. The upper end 120*b* of belly spring 120 is inserted into annular space 40*q* (FIG. 1B) between spacer 70 and barrel 40. Fasteners 40*r* and 40*s* secure the upper end 120*b* of belly spring 120 to barrel 40.

The assembly is completed when extension 105 is threaded into the lower end 103*a* of extension tube 103 and pin 105*e* is inserted through bores 103*b* and 105*d*. Extension 103 is threaded to the lower end 104*a* of adapter 104 and secured in that position via lock ring 101 and alignment pin 102. Adapter 104 is threaded into the lower end 40*p* of barrel 40. The upper end 104*b* of adapter 104 extends into barrel 40 and supports stop wedge 130 therein as will be more fully described hereinbelow.

When the components are assembled as described above, lubricating fluid may escape from stop zone 40*e* through passage 130*a* in stop wedge 130, into aligned bores 104*c*, 103*d* and out of tool A through ports 103*e* and 103*f*.

Using the longitudinal center line 40*t* (see FIG. 2) as a frame of reference, the radial distance from center line 40*t* to the edges 70*d* and 70*e*, exceeds the radial distance from center line 40*t* to curved surfaces 80*b* (FIG. 1C), 110*a* (FIG. 1B), and 106*a* (FIG. 1B). With that arrangement, edges 70*b* and 70*e* and similarly disposed edges on spacer 100 make contact with the lower end of the tubing wall in a deviated tube. Counterweights 80, 106 and 110 by having outer curved surfaces that extend beyond flat surface 70*c* permit the tool A to roll within the tubing as it is being lowered to the desired location whereby the tool can firmly station itself within the tubing when edges 70*e* and 70*d* and the corresponding edges on spacer 100 are in contact with the lower end of the the deviated tube. Belly spring 120 in conjunction with spacers 70 and 100 firmly position the tool A within the deviated tube by pressing against the upper end of the tube, thereby applying a spring force against flat surfaces 70*c* and 100*a* and securing the tool within the tubing for firing.

Stop wedge 130 can be constructed of a suitable soft metal such as bronze or aluminum to receive the drive wedge 50 after it has been propelled from the initial position to the fired position. Stop wedge 130 has a flat tapered surface 130*b* designed to allow uniform contact with flat tapered surface 50*c* of drive wedge 50 when drive wedge 50 is in the fired position. The proper orientation of stop wedge 130 within stop zone 40*e* is insured by the use of fastener 130*c*.

In the operation of the tool A, detonator 38 sets off the explosive powder 30, thereby driving plug 36 against seals 37. Seals 37 can be one or more resilient seals in a stack so as to prevent the passage of explosive gases around the periphery of drive wedge 50. Initial movement of drive wedge 50 shears pin 60*a* and downward movement of the wedge 50 reduces the effective volume of drive zone 40*d* between drive wedge 50 and piston 90, thereby resulting in a fluid pressure increase. The pressure increase in drive zone 40*d* equalizes in stop zone 40*e* via flow of fluid through longitudinal bore 90*g* extending through piston P. As drive wedge 50 continues to move, lubricating fluid is forced out of openings 40*h* and 40*i* as well as openings 40*g*, 80*a* and 130*a* (see FIG. 1B). Accordingly, the pressure underneath inner surface 90*b* of piston P as well as above surface 90*e* and below surface 90*q*, is equalized. It is the build up of fluid pressure within the longitudinal cavity 40*c* which is greater than the pressure in the tubing externally of the piston P that propels piston P from its initial position shown in FIG. 1B to a fired position wherein insert 90*k* is embedded in the tubing (not shown). The longitudinal bore 90*g* in piston P results in pressure equalization since the diameter of piston P is larger than that of drive wedge 50 and thereby blocks travel of the lubricating fluid around it and the piston P is actually blown out through the lateral or radial passage 40*f*. Except in cases where the resistance of the tubing being penetrated is so large that the fluid pressure acting laterally on the piston P is insufficient to force the insert 90*k* fully into the tubing, the drive wedge 50 does not contact the piston P at all during the insertion of the insert 90*k*. Therefore, in most situations, the perforation is performed by hydraulic action with the drive wedge 50 acting as a backup force to the mechanical should tubing conditions render it necessary. One of the benefits of this method is that wear on the piston P drive wedge 50 and barrel 40 are greatly minimized.

In order to regulate the force with which the piston P is propelled against the tubing, vent openings 40*h*, 40*i*, 40*g*, 80*a* and 130*a* must be sized so as to regulate the rate of pressure build up and dissipation within the barrel 40. As seen in FIGS. 1A and 1B, explosive gas vent bores 40*j* and 40*k* remain covered by drive wedge 50 as it is being driven from its initial position toward its fired position. As the top surface 50*e* of drive wedge 50 comes toward the edge of radial passage 40*f*, the explosive gases that powered the drive wedge 50 are vented before they can reach the radial passage 40*f*. This venting action prevents the explosive gases from further propelling the drive wedge 50 which in turn limits the force with which piston P is propelled through radial passage 40*f* and against the tubing. Should additional force be necessary such as in using the tool A in 5½" tubing, openings 40*h* and 40*i* can be sealed by use of a threaded plug (not shown).

The tool A of the present invention allows the explosive gases to vent through openings 40*j* and 40*k* through openings 70*f* and 70*g* in spacer 70, and thus the pressures within the barrel 40 are kept to a level that is only what is required to do the work of perforating the tubing in front of piston P. If for some reason the piston P is stopped by the tubing before it perforates the tubing, the drive wedge 50 may be forced into actual sliding contact with the angled surface or taper 90*c* of piston P. In that event, direct mechanical wedging action of the wedge 50 to force the piston P laterally outwardly occurs. The gas pressure above top surface 50*e* of drive wedge 50 will build until the piston P either continues to move or the maximum pressure that the powder load is capable of is reached and the gases begin to leak out around the drive wedge 50.

Despite the lower pressures that are used within the barrel of the tool A of the present invention as compared to prior tools, the barrel 40 of the tool A must still be strong enough to resist the possible pressures that would develop during a mechanical wedge action takeover situation. In the use of the tool disclosed in U.S. Pat. No. 3,199,287, the maximum pressure always developed regardless of well condition since the drive wedge was always being driven under pressure even when it was impacting the stop wedge.

In contrast to that device the tool A of the present invention provides for the drive wedge 50 to pass completely into stop zone 40*e*. Accordingly, after the piston P has been shot through radial passage 40*f*, the piston may fall back into the barrel 40 without contacting drive wedge 50. In the use of the tool of U.S. Pat. No. 3,199,287, the piston could only fall back into the barrel until it hit the drive wedge which in turn had to be stopped underneath the piston via the stop wedge. In the previous design, the drive wedge had to be stopped before the explosive gases could reach the piston bore because the drive wedge and the piston were in a sliding, highly loaded contact with each other and therefore the contact surface area had to remain high. If the contact area were to get too small, then the metal would be deformed and cause the wedge to jam itself in the bore on the far side of the piston bore.

The piston P of the tool A of the present invention has been radiused by the addition of arcuate depressed surface 90*b* within taper 90*c*. As a result, the cylindrical upper end 50*a* of drive wedge 50 maintains line contact with the piston P as the drive wedge 50 passes beyond radial passage 40*f*. This occurs after initial contact between surface 90*c* of piston P and flat surface 50*c* of drive wedge 50. The drive wedge 50 does not need a flat spot as in the design of U.S. Pat. No. 3,199,287 and therefore there is no need to have a separate full radius section further up on the drive wedge to maintain the pressure seal. The line contact between cylindrical upper surface 50*a* and arcuate depressed surface 90*b* of piston P allows the drive wedge 50 to pass by piston P on its way to stop zone 40*e* without the danger of deformation in a highly loaded sliding mechanical contact situation as was present in the prior tool of U.S. Pat. No. 3,199,287.

The drive wedge 50 is far less complex in the tool of the present invention and is therefore easy to make and less likely to bend under heavy pressures. The drive wedge 50 does not restrict the piston P from retracting. Stopping the drive wedge 50 in a specific place is not important since the drive wedge 50, in its fired position, is completely below radial passage 40*f*. The drive wedge 50 does not need to be explosively driven into the stop wedge so that a specific portion of the drive wedge presents itself by the piston bore, thereby allowing the piston P to retract back into the tool A. Therefore, the explosive gases may be vented, thereby allowing the drive wedge 50 to coast to a stop anywhere within stop zone 40*e*. Since the drive wedge 50 is nonexplosively propelled into contact with the stop wedge 130, it becomes far simpler to retract the drive wedge 50 from stop zone 40*e* so that the gun may be refired. In the present invention, threaded opening 50*f* can be used to engage a threaded rod and pull the drive wedge 50 from stop zone 40*e* with a minimum of effort.

As can readily be seen the primary mode of force in propelling piston P through radial opening 40*f* is the build-up of pressure on the fluid within longitudinal cavity 40*c*. Should the tubing to be perforated offer additional resistance, mechanical wedging action can take over between drive wedge 50 and piston P to complete the perforation task. The drive wedge 50 passes by piston P on its way into stop zone 40*e* under line contact, thereby removing the danger of component deformation.

The foregoing disclosure and description of the invention are illustrative and explanatory thereof, and various changes in the size, shape and materials, as well as in the details of the illustrated construction may be made without departing from the spirit of the invention.

I claim:

1. An explosive tool for perforating tubing comprising:

an elongated barrel having a longitudinal cavity therein, said cavity adapted to be filled with a fluid, said barrel having a lateral passage in communication with said longitudinal cavity and the outer surface of said barrel, said lateral passage dividing said cavity into a drive zone and a stop zone;

a piston initially disposed within said longitudinal cavity in alignment with said lateral passage and substantially closing said lateral passage, and laterally movable from said initial position to a fired position wherein said piston extends through said lateral passage of said barrel;

said piston having a longitudinal bore therethrough, such that when said piston is in said initial position said longitudinal bore provides a restricted flow passage for said fluid through said piston; and means for explosively increasing the pressure in said longitudinal cavity to provide a fluid pressure build-up in said longitudinal cavity which forces said piston laterally from said initial position to said fired position.

2. The tool of claim 1, further including:

means for regulating the rate of dissipation of pressure in said longitudinal cavity thereby controlling the force which propels said piston from said initial position to said fired position.

3. The tool of claim 2 wherein said pressure increasing means further comprises:

a drive wedge disposed within said longitudinal cavity for selective movement therein from an initial position wherein said drive wedge is disposed in said drive zone to a fired position wherein said wedge is disposed in said stop zone.

4. The tool of claim 3 wherein:

said drive wedge has an upper end conforming to the cross sectional shape of said longitudinal cavity and a lower end having a substantially flat tapered surface.

5. The tool of claim 4 further including:

a stop wedge disposed in said stop zone and having a flat tapered surface thereon, said tapered surface positioned to make contact with said flat tapered surface of said drive wedge when said drive wedge has moved fully into said fired position.

6. The tool of claim 5 wherein:

said stop wedge is formed having a fluid passage therethrough thereby allowing the fluid to escape from said stop zone as said drive wedge is propelled from said initial to said fired position.

7. The tool of claim 4 wherein:

said piston has an outer surface disposed within said lateral opening when said piston is in said initial position, said piston has an inner surface having a taper thereon at the upper end of said piston adjacent said drive zone of said longitudinal cavity.

8. The tool of claim 7 wherein:

said flat tapered surface of said drive wedge is substantially aligned with said tapered surface of said piston;

whereupon when fluid pressure alone is insufficient to propel said piston laterally from said barrel to penetrate a tubing, said taper on said wedge contacts said taper on said piston to further outwardly propel said piston from said longitudinal cavity by a combination of fluid and mechanical force.

9. The tool of claim 8 wherein:

said tapered surface on said piston further includes an arcuate depressed, surface thereon;

said upper end of said drive wedge is cylindrically shaped;

whereupon when fluid pressure alone is insufficient to propel said piston laterally from said barrel to penetrate a tubing and said drive wedge contacts said piston, said upper end of said drive wedge engages said arcuate depressed surface of said piston inner surface, to further outwardly propel said piston from said longitudinal cavity by a combination of fluid and mechanical force.

10. The tool of claim 9 wherein said barrel further comprises:

a piston spring, said piston spring contacting said piston as it is propelled to its fired position and biasing said piston toward its initial position after said drive wedge has been propelled beyond said lateral passage and into its fired position.

11. An explosive tool for perforating tubing comprising:

an elongated barrel having a longitudinal cavity therein, said cavity adapted to be filled with a fluid, said barrel having a lateral passage in communication with said longitudinal cavity and the outer surface of said barrel, said lateral passage dividing said cavity into a drive zone and a stop zone;

a piston initially disposed within said longitudinal cavity in alignment with said lateral passage and substantially closing said lateral passage, and laterally movable from said initial position to a fired position wherein said piston extends through said lateral passage of said barrel;

said piston having a longitudinal bore therethrough, such that when said piston is in said initial position said longitudinal bore provides a restricted flow passage for said fluid through said piston;

means for explosively increasing the pressure in said longitudinal cavity to provide a fluid pressure buildup in said longitudinal cavity which forces said piston laterally from said initial position to said fired position;

a drive wedge disposed within said longitudinal cavity for selective movement therein from an initial position wherein said drive wedge is disposed in said drive zone to a fired position wherein said wedge is disposed in said stop zone;

said drive wedge has an upper end conforming to the cross sectional shape of said longitudinal cavity and a lower end having a substantially flat tapered surface;

said piston has an outer surface disposed within said lateral opening when said piston is in said initial position, said piston has an inner surface having a taper thereon at the upper end of said piston adjacent said drive zone of said longitudinal cavity;

said flat tapered surface of said drive wedge is substantially aligned with said tapered surface of said piston;

whereupon when fluid pressure alone is insufficient to propel said piston laterally from said barrel to penetrate a tubing, said taper on said wedge contacts said taper on said piston to further outwardly propel said piston from said longitudinal cavity by a combination of fluid and mechanical force;

said tapered surface on said piston further includes an arcuate depressed, surface thereon;

said upper end of said drive wedge is cylindrically shaped;

whereupon when fluid pressure alone is insufficient to propel said piston laterally from said barrel to penetrate a tubing and said drive wedge contacts said piston, said upper end of said drive wedge engages said arcuate depressed surface of said piston inner surface, to further outwardly propel said piston from said longitudinal cavity by a combination of fluid and mechanical force;

a piston spring, said piston spring contacting said piston as it is propelled to its fired position and biasing said piston toward its initial position after said drive wedge has been propelled beyond said lateral passage and into its fired position;

an adapter segment mounted to said outer surface of said piston and disposed to be sheared off said piston; and means for regulating the rate of dissipation of pressure in said longitudinal cavity thereby controlling the force which propels said piston from said initial position to said fired position.

12. The tool of claim 11 further including:

a piston retaining pin to hold said piston in said initial position until said drive wedge is explosively propelled to shear said pin with the lower end of said drive wedge.

13. The tool of claim 12 further comprising:

an insert mounted to said adapter segment, said insert penetrating and remaining embedded in the tubing when said piston is propelled from said initial position into said fired position, said insert having a bore therethrough whereon the impact of penetration by said insertion of the tubing dislodges said insert from said adapter thereby allowing said piston spring to bias said piston toward said initial position.

14. The tool of claim 13 wherein:

said barrel is formed having a lower vent bore extending from the outer surface of said barrel into said stop zone of said longitudinal cavity, thereby regulating the rate of pressure dissipation within said longitudinal cavity by letting lubricating fluid escape from said longitudinal cavity when said drive wedge is explosively propelled from its initial position to its fired position.

15. The tool of claim 14 wherein:

said barrel is formed having an upper vent bore extending from the outer surface of said barrel into said drive zone of said longitudinal cavity, said upper vent bore remaining unobstructed by said lower end of said drive wedge when said drive wedge is in said initial position, thereby regulating the rate of pressure dissipation within said longitudinal cavity by letting lubricating fluid escape from said longitudinal cavity with said drive wedge is explosively propelled from its initial position to its fired position.

16. The tool of claim 15 wherein said barrel further comprises:

an explosive gas vent bore extending from the outer surface of said barrel into said drive zone adjacent said radial passage for said piston, said explosive gas vent bore being obstructed by said drive wedge in its initial position, whereupon the drive wedge is slowed as it moves from said initial position toward its fired position when the explosive pressure is vented from said drive zone as said upper end of said drive wedge travels beyond said explosive gas vent bore.

17. The tool of claim 16 further including:

a stop wedge disposed in said stop zone and having a flat tapered surface thereon, said tapered surface positioned to make contact with said flat tapered surface of said drive wedge when said drive wedge has moved fully into said fired position.

18. The tool of claim 17, wherein:

said stop wedge is formed having a fluid passage therethrough thereby allowing the fluid to escape from said stop zone as said drive wedge is propelled from said initial position to said fired position.

19. The tool of claim 18 further including:

a longitudinal rounded counterweight connected to the outer surface of said barrel having its bulk radially opposed from said piston lateral passage;

whereupon when the tool is inserted into nonvertical tubing to be perforated, said counterweight positions the tool by gravity adjacent the lowermost point in the tube with said piston aimed to penetrate the uppermost point in the tube.

20. The tool of claim 19 further including:

at least two removably mounted spacers each having a flat thereon adapted to engage the tubing wall in two parallel line contact to stabilize the tool adjacent the lowermost portion of the tubing before firing.

21. The tool of claim 20 further including:

a belly spring longitudinally mounted to said barrel radially opposed to said counterweights and spacers to stabilize the tool within the tubing by pressing against the tubing inner wall when the tool is positioned within the tubing for firing.

22. An explosive tool for perforating tubing comprising:

an elongated barrel having a longitudinal cavity therein, said cavity adapted to be filled with a fluid, said barrel having a lateral passage in communication with said longitudinal cavity and the outer surface of said barrel, said lateral passage dividing said cavity into a drive zone and a stop zone;

a piston initially disposed within said longitudinal cavity in alignment with said lateral passage and substantially closing said lateral passage, and laterally movable from said initial position to a fired position wherein said piston extends through said lateral passage of said barrel;

said piston having a longitudinal bore therethrough, such that when said piston is in said initial position said longitudinal bore provides a restricted flow passage for said fluid through said piston;

means for explosively increasing the pressure in said longitudinal cavity to provide a fluid pressure buildup in said longitudinal cavity which forces said piston laterally from said initial position to said fired position;

a drive wedge disposed within said longitudinal cavity for selective movement therein from an initial position wherein said drive wedge is disposed in said drive zone to a fired position wherein said wedge is disposed in said stop zone;

said drive wedge has an upper end conforming to the cross sectional shape of said longitudinal cavity and a lower end having a substantially flat tapered surface;

means for regulating the rate of dissipation of pressure in said longitudinal cavity thereby controlling the force which propels said piston from said initial position to said fired position; and said barrel is formed having a lower vent bore extending from the outer surface of said barrel into said stop zone of said longitudinal cavity, thereby regulating the rate of pressure dissipation within said longitudinal cavity by letting lubricating fluid escape from said longitudinal cavity when said drive wedge is explosively propelled from its initial position to its fired position.

23. The tool of claim 22 wherein:

said barrel is formed having a lower vent bore extending from the outer surface of said barrel into said drive zone of said longitudinal cavity, said upper vent bore remaining unobstructed by said lower end of said drive wedge when said drive wedge is in said initial position, thereby regulating the rate of pressure dissipation within said longitudinal cavity by letting fluid escape from said longitudinal cavity when said drive wedge is explosively propelled from its initial position to its fired position.

24. The tool of claim 23, wherein said barrel further comprises:

an explosive gas vent bore extending from the outer surface of said barrel into said drive zone adjacent said radial passage for said piston, said explosive gas vent bore being obstructed by said drive wedge in its initial position, whereupon the drive wedge is slowed as it moves from said initial position toward its fired position when the explosive pressure is vented from said drive zone as said upper end of said drive wedge travels beyond said explosive gas vent bore.

25. An explosive tool for perforating tubing comprising:

an elongated barrel having a longitudinal cavity therein, said cavity adapted to be filled with a fluid, said barrel having a lateral passage in communication with said longitudinal cavity and the outer surface of said barrel, said lateral passage dividing said cavity into a drive zone and a stop zone;

a piston initially disposed within said longitudinal cavity in alignment with said lateral passage and substantially closing said lateral passage, and laterally movable from said initial position to a fired position wherein said piston extends through said lateral passage of said barrel;

said piston having a longitudinal bore therethrough, such that when said piston is in said initial position said longitudinal bore provides a restricted flow passage for said fluid through said piston;

means for explosively increasing the pressure in said longitudinal cavity to provide a fluid pressure buildup in said longitudinal cavity which forces said piston laterally from said initial position to said fired position;

a longitudinal rounded counterweight connected to the outer surface of said barrel having its bulk radially opposed from said piston lateral passage;

whereupon when the tool is inserted into non-vertical tubing to be perforated, said counterweight permits said tool to roll and positions the tool, by gravity, adjacent the lowermost point in the tube with said piston aimed to penetrate the uppermost point in the tube.

26. The tool of claim 25 further including:

at least two removably mounted spacers each having a flat thereon adapted to engage the tubing wall in two parallel line contact to stabilize the tool adjacent the lowermost portion of the tubing before firing.

27. The tool of claim 26 further including:

a belly spring longitudinally mounted to said barrel radially opposed to said counterweights and spacers to stabilize the tool within the tubing by pressing against the tubing inner wall when the tool is positioned within the tubing for firing.

* * * * *